US009373245B2

(12) United States Patent
Gerrish et al.

(10) Patent No.: US 9,373,245 B2
(45) Date of Patent: Jun. 21, 2016

(54) SMART NOTIFICATION APPLIANCES

(71) Applicants: Kevin Gerrish, Largo, FL (US); Ted Milburn, Bradenton, FL (US)

(72) Inventors: Kevin Gerrish, Largo, FL (US); Ted Milburn, Bradenton, FL (US)

(73) Assignee: Cooper Technologies Company, Houston, TX (US)

( * ) Notice: Subject to any disclaimer, the term of this patent is extended or adjusted under 35 U.S.C. 154(b) by 429 days.

(21) Appl. No.: 13/774,884

(22) Filed: Feb. 22, 2013

(65) Prior Publication Data

US 2014/0241533 A1 Aug. 28, 2014

(51) Int. Cl.

| | |
|---|---|
| ***G08B 25/04*** | (2006.01) |
| ***H04R 27/00*** | (2006.01) |
| *G08B 5/22* | (2006.01) |
| *G08B 7/06* | (2006.01) |
| *G08B 3/10* | (2006.01) |
| *G08B 25/08* | (2006.01) |

(52) U.S. Cl.

CPC ..... *G08B 25/04* (2013.01); *H04R 27/00* (2013.01); *G08B 3/10* (2013.01); *G08B 5/22* (2013.01); *G08B 7/06* (2013.01); *G08B 25/085* (2013.01); *H04S 2400/13* (2013.01)

(58) Field of Classification Search

CPC . G08B 5/22; G08B 5/36–5/38; G08B 25/008; G08B 25/04; G08B 25/085; G08B 25/14; G08B 3/10; G08B 7/06; Y10T 307/74; H04R 27/00; H04S 2400/13

See application file for complete search history.

(56) References Cited

U.S. PATENT DOCUMENTS

| | | | | |
|---|---|---|---|---|
| 5,559,492 | A * | 9/1996 | Stewart et al. | 340/331 |
| 2003/0080865 | A1 * | 5/2003 | Capowski et al. | 340/506 |
| 2003/0169177 | A1 * | 9/2003 | Curran et al. | 340/691.4 |
| 2004/0056773 | A1 * | 3/2004 | Zimmerman et al. | 340/815.4 |
| 2004/0140891 | A1 * | 7/2004 | Capowski et al. | 340/506 |
| 2005/0128097 | A1 * | 6/2005 | Piccolo et al. | 340/691.1 |
| 2005/0219060 | A1 * | 10/2005 | Curran et al. | 340/815.45 |
| 2005/0222820 | A1 * | 10/2005 | Chung | 702/188 |
| 2005/0280526 | A1 * | 12/2005 | Kalafarski | 340/510 |
| 2006/0214811 | A1 * | 9/2006 | Barrieau et al. | 340/635 |
| 2007/0035407 | A1 * | 2/2007 | Capowski et al. | 340/679 |
| 2007/0096895 | A1 * | 5/2007 | Sneade, Jr. | 340/506 |
| 2007/0115111 | A1 * | 5/2007 | Girouard | 340/507 |
| 2008/0157992 | A1 * | 7/2008 | Anderson et al. | 340/691.1 |

(Continued)

OTHER PUBLICATIONS

Simplex. True Alert Addressable Notification Appliances. May 2013.

*Primary Examiner* — Hai Phan
*Assistant Examiner* — Orlando Bousono
(74) *Attorney, Agent, or Firm* — King & Spalding LLP

(57) ABSTRACT

Smart notification appliances used in a mass notification system (MNS) have integrated software and distributed hardware for real time information to in-building, immediate vicinity and distributed recipients during emergency situations. Programmable control configurations in the smart notification appliances provide flexible installations. A distributed architecture system provides distributed intelligence in the smart notification appliances for maximum survivability and robust operation of the MNS. Audio messages are stored in each smart notification appliance with a one-to-one relationship to a speaker circuit. This configuration provides any circuit with either a live page or a plurality of preconfigured messages, in effect a multi-channel system limited only by the number of stored messages and controllable by software. Similarly, programmable light strobe intensity, flash rate and color may be controlled through the smart notification appliances.

10 Claims, 4 Drawing Sheets

(56) References Cited

U.S. PATENT DOCUMENTS

| | | | | |
|---|---|---|---|---|
| 2009/0091466 | A1* | 4/2009 | Sendrowski, Jr. | 340/691.1 |
| 2009/0153339 | A1* | 6/2009 | Curran et al. | 340/657 |
| 2009/0219162 | A1* | 9/2009 | Leach et al. | 340/628 |
| 2009/0309740 | A1* | 12/2009 | Savage, Jr. | 340/577 |
| 2009/0322526 | A1* | 12/2009 | Lontka | 340/540 |
| 2010/0052935 | A1* | 3/2010 | Curran et al. | 340/815.45 |
| 2010/0052936 | A1* | 3/2010 | Curran et al. | 340/815.45 |
| 2010/0066557 | A1* | 3/2010 | Henson et al. | 340/693.1 |
| 2010/0188234 | A1* | 7/2010 | Farley et al. | 340/577 |
| 2010/0207777 | A1* | 8/2010 | Woodford | 340/815.45 |
| 2010/0234971 | A1* | 9/2010 | Hagiwara et al. | 700/94 |
| 2010/0241257 | A1* | 9/2010 | Takahashi et al. | 700/94 |
| 2010/0265080 | A1* | 10/2010 | Henson | 340/657 |
| 2010/0315224 | A1* | 12/2010 | Orsini et al. | 340/516 |
| 2011/0043367 | A1* | 2/2011 | Becker et al. | 340/577 |
| 2011/0082486 | A1* | 4/2011 | Messerly et al. | 606/169 |
| 2012/0013480 | A1* | 1/2012 | Curran et al. | 340/815.45 |
| 2012/0068841 | A1* | 3/2012 | Piccolo, III | 340/501 |
| 2012/0068853 | A1* | 3/2012 | Curran et al. | 340/815.45 |
| 2012/0154160 | A1* | 6/2012 | Piccolo, III | 340/628 |
| 2012/0188107 | A1* | 7/2012 | Ashburn et al. | 341/110 |
| 2012/0263329 | A1* | 10/2012 | Kjeldsen et al. | 381/315 |
| 2013/0002424 | A1* | 1/2013 | Haynes | 340/540 |
| 2013/0027198 | A1* | 1/2013 | Piccolo, III | 340/506 |
| 2013/0201316 | A1* | 8/2013 | Binder et al. | 348/77 |

* cited by examiner

SMART NOTIFICATION APPLIANCES

TECHNICAL FIELD

The present disclosure relates to mass notification systems (MNS), and more particularly, to addressable and programmable smart notification appliances used in the MNS.

BACKGROUND

In mass notification systems (MNS), notification appliances exist that may accept broadcast configuration commands to all of the notification appliances but not to individual appliances. For example, a synch protocol allows horn type notification appliances to be either silenced or not. However, this only allows for all or none of the notification appliances on a given circuit to be controlled and does not allow for individual control over specific notification appliances. Additionally, the ability to configure an individual notification appliance for light and/or sound output level(s), or continuous versus repetitive light and/or sounding patterns (such as code 3) are physically set in the appliance, e.g., using selector switches, at the time of hardware installation thereof. Also traditional notification appliances do not have a mechanism to report error or trouble conditions as there is no return communication path. Therefore, current notification appliances have limited capability to be "soft configured" after installation based upon overall system need.

SUMMARY

Therefore, a need exists for "smart" notification appliances that have the ability to be remotely configured and report back the their status. To accomplish this the notification appliance is addressable to allow the controlling mass notification system (MNS) to distinguish and individually communicate with each smart notification appliance connected to it.

According to an embodiment, a smart notification appliance may comprise: first and second communication ports; first and second communications transceivers coupled to the first and second communication ports, respectively; a message memory for storing at least one annunciation message; mixed signal processing apparatus coupled to the first and second communications transceivers, and the message memory; and at least one power supply coupled to the first and second communication ports, the first and second communications transceivers, and the mixed signal processing apparatus; wherein the mixed signal processing apparatus may comprise at least one analog input, at least one digital input, at least one analog output, and at least one digital output; wherein the at least one analog input, the at least one analog output, the at least one digital input and the at least one digital output may be remotely monitored and controlled by a mass notification system through the first or the second communications port.

According to a further embodiment, a network time synchronization circuit for synchronizing time clocks in each one of a plurality of smart notification appliances may be coupled together through respective ones of the first and second communication ports. According to a further embodiment, the at least one power supply may comprise at least two power supplies for redundancy and further may comprise a power supply synchronization circuit coupled to and synchronizing together the at least two power supplies.

According to a further embodiment, the mixed signal processing apparatus may comprise: a digital processor and program memory; a least one digital-to-analog converter (DAC) coupled between the digital processor and the at least one analog output; an analog-to-digital converter (ADC) coupled to the digital processor; an analog multiplexer coupled to the ADC and having at least one input thereof coupled to the at least one analog input; at least one digital receiver coupled between the at least one digital input and the digital processor; and at least one digital output driver coupled between the digital processor and the at least one digital output. According to a further embodiment, a programming interface may be coupled to the digital processor.

According to a further embodiment, at least one light sensor may be coupled to the at least one analog input; and at least one light strobe may be coupled to the at least one digital output; wherein the least one light sensor may provide an ambient light value to the mixed signal processing apparatus and the mixed signal processing apparatus may control a light output level of the at least one light strobe at the ambient light value plus a light threshold valve up to a maximum light output level.

According to a further embodiment, the at least one light strobe may comprise at least one power light emitting diode. According to a further embodiment, the at least one light strobe may be a plurality of different colored light strobes controlled by the mixed signal processing apparatus.

According to a further embodiment, at least one sound sensor may be coupled to the at least one analog input; and at least one power speaker may be coupled to the at least one analog output; wherein the least one sound sensor may provide an ambient sound value to the mixed signal processing apparatus and the mixed signal processing apparatus may control a sound output level of the at least one power speaker at the ambient sound value plus a sound threshold valve up to a maximum sound output level.

According to a further embodiment, smoke and fire detectors may be coupled through analog or digital inputs to the mixed signal processing apparatus. According to a further embodiment, intrusion detectors may be coupled through analog or digital inputs to the mixed signal processing apparatus.

According to another embodiment, a method for automatically adjusting a light level of a strobe light with a smart notification appliance may comprise the steps of: measuring an ambient light level with a light sensor; adding a threshold level to the measured ambient light level; determining if a sum of the threshold level and the measured ambient light level may be greater than a maximum light level, wherein if the sum may be greater than the maximum light level then setting the light level of the strobe light to the maximum light level, and if the sum may be less than or equal to the maximum light level then setting the light level of the strobe light to the sum of the threshold level and the measured ambient light level.

According to a further embodiment of the method, before the step of measuring the ambient light level may further comprise the steps of: determining whether an adjust mode may be active, wherein if the adjust mode may be not active, then setting the light level of the strobe light to a selected light level, and if the adjust mode may be active, then enabling an ambient light mode and going to the step of measuring the ambient light level.

According to a further embodiment of the method, the step of measuring the ambient light level may further comprise the steps of measuring a plurality of ambient light levels over a programmable time period and averaging the measured plurality of ambient light levels before adding the threshold level to the averaged measured plurality of ambient light levels. According to a further embodiment of the method, the step of setting the light level of the strobe light to the maximum light level may be when detecting a failure of the light sensor. According to a further embodiment of the method, a further step may be controlling a plurality of different color strobe lights.

According to yet another embodiment, a method for automatically adjusting a sound level of an audio speaker with a smart notification appliance may comprise the steps of: measuring an ambient sound level with a audio sound sensor; adding a threshold level to the measured ambient sound level; determining if a sum of the threshold level and the measured ambient sound level may be greater than a maximum sound level, wherein if the sum may be greater than the maximum sound level then setting the sound level of the speaker to the maximum sound level, and if the sum may be less than or equal to the maximum sound level then setting the sound level of the speaker to the sum of the threshold level and the measured ambient sound level.

According to a further embodiment of the method, before the step of measuring the ambient sound level may further comprise the steps of: determining whether an adjust mode may be active, wherein if the adjust mode may not be active, then setting the sound level of the speaker to a selected sound level, and if the adjust mode may be active, then enabling an ambient sound mode and going to the step of measuring the ambient sound level.

According to a further embodiment of the method, the step of measuring the ambient sound level may further comprise the steps of measuring a plurality of ambient sound levels over a programmable time period and averaging the measured plurality of ambient sound levels before adding the threshold level to the averaged measured plurality of ambient sound levels. According to a further embodiment of the method, the step of setting the sound level of the speaker to the maximum sound level may be when detecting a failure of the audio sound sensor.

BRIEF DESCRIPTION OF THE DRAWINGS

A more complete understanding of the present disclosure may be acquired by referring to the following description taken in conjunction with the accompanying drawings wherein.

Figure 1:
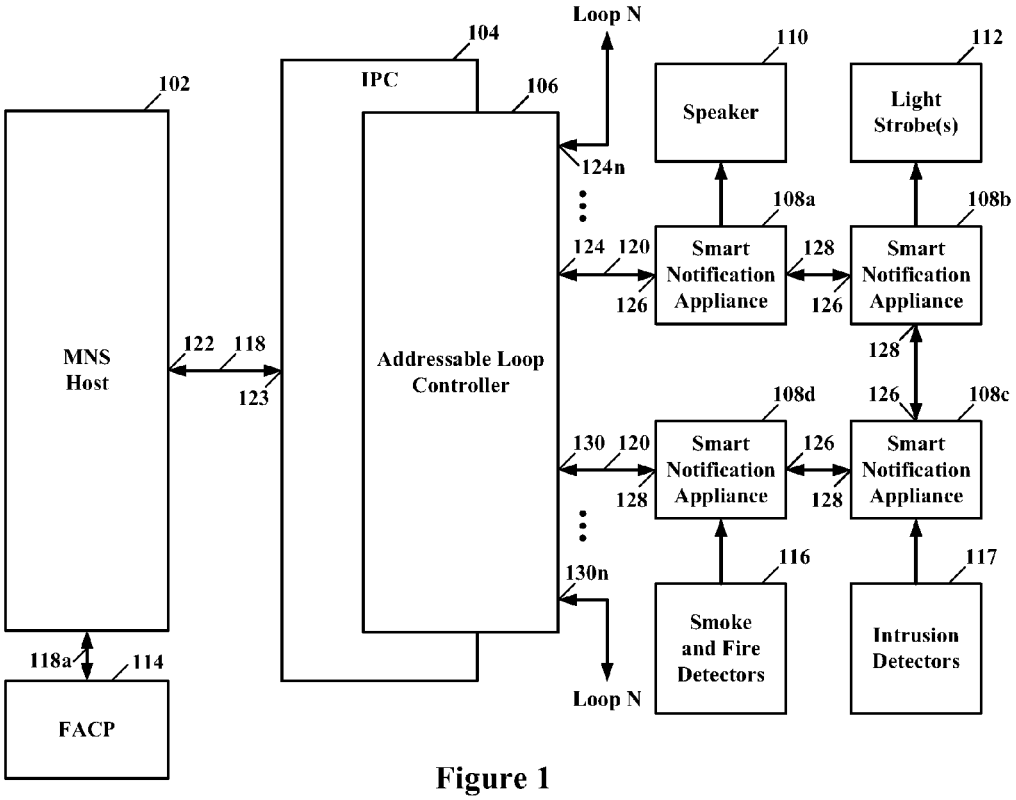
FIG. 1 illustrates a schematic block diagram of a mass notification system (MNS) having a loop communications controller and a plurality of smart notification appliances, according to a specific example embodiment of this disclosure.

While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims.

DETAILED DESCRIPTION

A mass notification system (MNS) may comprise integrated software and distributed hardware that provides real time information to in-building, immediate vicinity and distributed recipients during emergency situations. The MNS may use programmable control configurations to provide flexible installations. The MNS may be a distributed architecture system having distributed intelligence to maximize survivability and robust operation. Audio messages may be stored in each smart notification appliance with a one-to-one relationship to a speaker circuit. This configuration may provide any circuit with either a live page or a plurality of preconfigured messages, in effect a multi-channel system limited only by the number of stored messages in the MNS, controllable by software.

Referring now to the drawings, the details of specific example embodiments are schematically illustrated. Like elements in the drawings will be represented by like numbers, and similar elements will be represented by like numbers with a different lower case letter suffix.

Referring to FIG. 1, depicted is a schematic block diagram of a mass notification system (MNS) having a loop communications controller and a plurality of smart notification appliances, according to a specific example embodiment of this disclosure. A MNS host computer 102 may be coupled to an Internet Protocol Communicator (IPC) 104 via, for example but is not limited to, a TCP/IP protocol over Ethernet, Internet, Wi-Fi, etc. The communications link 118 may be hard wired or wireless (using radio frequency modems not shown) coupled between appropriate communication port connectors 122 and 123, e.g., RJ-45. An addressable loop controller 106, integral with or separate from the IPC 106, is coupled to a plurality of smart notification appliances 108.

The addressable loop controller 106 may be coupled to the plurality of smart notification appliances 108 via, for example but not limited to, a TCP/IP protocol over Ethernet, Internet, Wi-Fi, etc. The communications links 120 may be hard wired or wireless (using radio frequency modems not shown) coupled between appropriate communication port connectors 124, 126, 128 and 130, e.g., RJ-45. The communications links 120 may be configured as loops 1-N as shown in FIG. 1. It also is contemplated and within the scope of this disclosure that the communications links 120 may be connected in a star configuration using, for example but not limited to, an Ethernet switch or router (not shown), and/or wireless Wi-Fi radio modems (not shown), etc. Each of the smart notification appliances 108 may be coupled to respective smoke and fire detectors 116, intrusion detectors 117, annunciation and warning light strobes 112, at least one speaker 110, etc., including any combination of one or more thereof. A fire alarm control panel (FACP) 114 may also be coupled to the MNS host computer 102.

The MNS host computer 102 may have the capability to connect to a fire alarm control panel (FACP) 114 and provide typical high-rise functionality for UL 2572 listing. It may also provide the functionality required by the Uniform Fire Code (UFC) standards and for global applications. Also it may provide a feature set appropriate for prosound or PA/GA applications, and may be used as an integrated platform for audio alerts, communications, paging, etc. This may be provided with addressable smart notification appliances 108 used in an audio distribution system rather than a defined set of hardware devices. The architecture disclosed and claimed herein may provide for distributed control and monitoring for various applications as more fully disclosed hereinafter.

In fire alarm applications, the FACP 114 may communicate the areas of alarm to this audio distribution system. The responsibility of notification may be an audio distribution system. The smart notification appliances 108 may manage multi-color strobes, e.g., light emitting diodes (LEDs), and/or different audio tones to differentiate between fire, alert and mass notification system (MNS) conditions. For fire alarm notification applications, it is anticipated and within the scope of this disclosure that there may be a defined hardware controller that may be used as an operator user interface. In this application a fire fighter's telephone system (two way communications) may be incorporated into this user interface.

In professional sound or PA/GA applications, IP controllers (IPC) 104 may be distributed throughout the area of coverage to service a geographic area. Each IPC 104 may manage individual speaker circuits, speakers and the selection and distribution of content to the speakers. In this application multiple paging stations, e.g., microphones integrated into local operating control (LOC) panels (not shown) may be supported with page priority and message storage.

Figure 2:
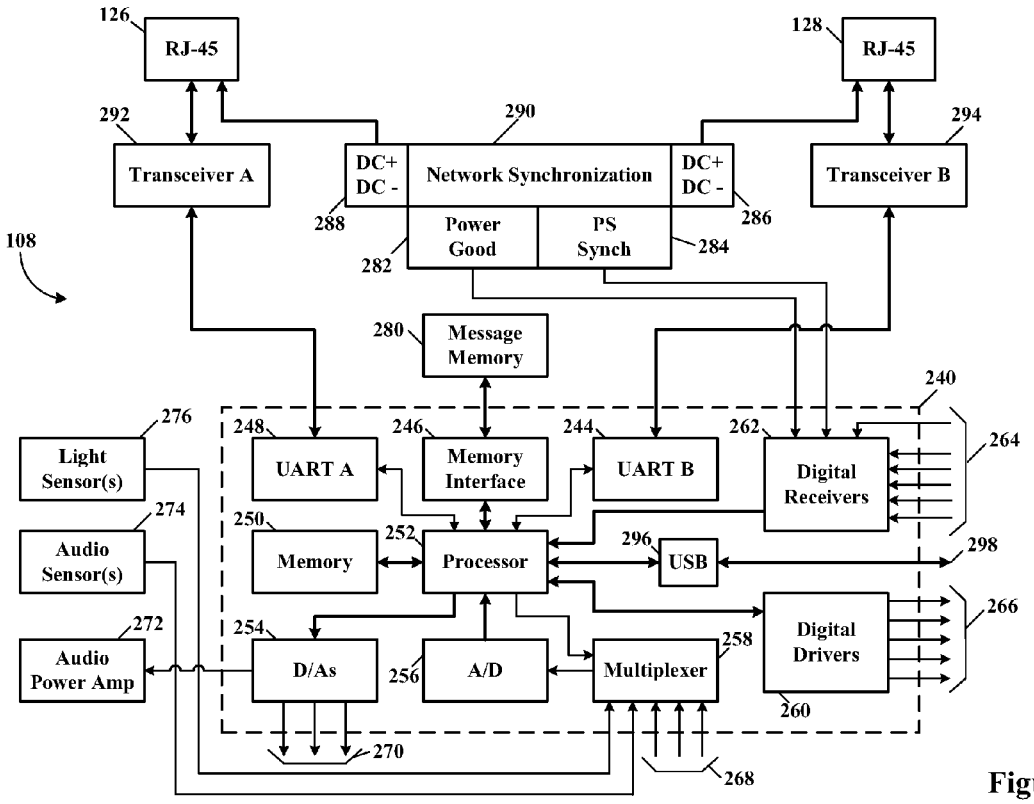
FIG. 2 illustrates a more detailed schematic block diagram of a smart notification appliance, according to a specific example embodiment of this disclosure.

Referring to FIG. 2, depicted is a more detailed schematic block diagram of a smart notification appliance, according to a specific example embodiment of this disclosure. A smart notification appliance, generally represented by the numeral 108, may comprise first and second communication transceivers 292 and 294 coupled to first and second communication port connectors 126 and 128, respectively; direct current (DC) power supplies 288 and 286, a power good monitor 282, a power supply synchronization circuit 284, a stored message memory 280, and mixed signal (digital and analog) processing apparatus 240, e.g., a microcontroller, microcomputer, application specific integrated circuit (ASIC), programmable logic array (PLA), and the like. At least one light sensor 276, at least one audio sensor 274, and/or audio power amplifier 272 may be coupled to the mixed signal processing apparatus 240.

The mixed signal processing apparatus 240 may comprise first and second UARTs 248 and 244, a memory interface 246 for coupling to the stored message memory 280, a digital processor 252 coupled to a program and data memory 250, at least one digital-to-analog converter (DAC) 254, and an analog-to-digital converter (ADC) 256. The mixed signal processing apparatus 240 may further comprise a plurality of digital input receivers 262 for receiving a plurality of digital inputs 264, a plurality of digital output drivers 260 for driving a plurality of digital outputs 266, an analog multiplexer 258 for receiving a plurality of analog inputs 268, and/or a communications interface 296 coupled to a local communications and test port 298, e.g., USB port. The analog multiplexer 258 may be coupled to the ADC 256 and controlled by the digital processor 252. The local communications and test port 298 may be used with a local test set (not shown) for maintenance and/or field programming of the smart notification appliance 108.

When the addressable loop controller 106 is configured in a ring communications system, the communications (data and/or control) to and from other smart notification appliances 108 will pass through, e.g., be received and retransmitted by the smart notification appliance 108 shown in FIG. 2. Data and/or control information intended for the instant smart notification appliance 108 may be processed by the associated digital processor 252 in accordance with the software program stored in the memory 250. Each of the plurality of smart notification appliances 108 has a unique address(es) that may be selectively accessed by the MNS host computer 102 through the IPC 104 and loop controller 106, and ultimately to the intended (matching address) smart notification appliance 108.

The mixed signal processing apparatus 240 is the core of the smart notification appliance 108, communicating with the network through the network first and second transceivers 292 and 294 and coupled to the network through the communication port connectors 126 and 128, respectively. To minimize wiring, the communication port connectors 126 and 128 may also be adapted to supply power and network synchronization signals to allow all smart notification appliances 108 to be activated and controlled within tight time periods. The digital processor 252 may address an external non-volatile memory 280, e.g., a FLASH based memory, that may be used to store local message content for the smart speaker application described hereinafter.

The DC power supplies 288 and 286 may be dual redundant or a single power supply having dual power outputs for providing power to each of the communication port connectors 126 and 128, and the mixed signal processing apparatus 240. The dual DC power supplies 288 and 286 may be further integrated for fail safe operation with the power supply synchronization circuit 284. A battery backup supply (not shown) may be included for operation of the respective smart notification appliance 108 during loss of primary power conditions. The battery backup supply may be charged from one or both of the DC power supplies 288 and 286. The power good monitor 282 may be coupled to a digital input 264. A network time synchronization circuit 290 may be used to synchronize time clocks in each of the smart notification appliances 108.

Smart light and audio capability may be facilitated by connecting a light intensity sensor 276 and an audio level sensor 274, respectively, to the mixed signal processing apparatus 240 through the analog inputs 268 coupled to an analog multiplexer 258 having an output coupled to the ADC 256. The ADC 256 provides for integration of light and sound level detection to be as sensitive as required by an application.

At least one speaker 110, e.g., powered speaker, may be driven from an analog output 270 from the DAC 254. This allows for a high degree of adjustment of the output volume of the at least one speaker 110. Similarly, power driver circuits (not shown) coupled to the light generation devices, e.g., xenon bulbs, LEDs, etc., may be incorporated into the light strobe(s) 112 and driven by a digital output(s) 266 from the mixed signal processing apparatus 240. More specific applications of the smart notification appliances 108 are disclosed hereinafter.

Auto Adjusting Strobe

One application for a smart notification appliance 108 is to reduce system energy consumed by a light strobe device by only delivering light strobe candela light output based upon ambient light conditions. Present technology light strobes are physically set for light output based upon a set of worst case ambient light conditions. This results in systems that deliver, on a consistent basis, more light than is required. This equates to increased power consumption, increased backup battery reserves, and increased system cost. In reality, the amount of light output needed by the strobe to be effective can vary depending on the changing ambient light conditions at the strobe location. Examples of these conditions may be for example but are not limited to:

Day light—requires higher light output

Night time—requires less light output

Indoor occupied with full artificial lighting—requires higher light output

Indoor non-occupied shutdown—requires less light output

Weekends where facilities are not occupied and dark—requires less light output

Warehouse with racking that is designed to be moved on a fairly consistent basis, e.g., the strobe was between racks, but now is in an open area requiring different light output levels Outdoor areas (day)—requires higher light output Outdoor areas (night)—requires less light output The traditional non-smart appliance would have a candela (cd) level switch setting which would set the light output at all times. The smart notification appliance 108 may have a switch setting or programmable software setting that may represent the maximum light output the strobe would be required to emit. To enable the auto adjusting feature, a light sensor 276 may be added to existing annunciation and warning light strobes 112. This light sensor 276, coupled to the mixed signal processing apparatus 240, may utilize a method for determining appropriate light intensity for adjusting the strobe light output levels to effectively function in existing light conditions. In general, this light output determination method may comprise the following steps:

Light sensor will sense ambient conditions and adjust active light output.

Transition light conditions are considered by utilizing an integration of a plurality of light intensity samples measured over a programmable period of time as opposed to instantaneous light transition.

The light output may be configured such that if there is a fault or failure within the light sensor or other major parts of the light strobe, the light strobe would communicate a trouble and have its light output default to the maximum setting programmed into the smart notification appliance 108.

For example, for an active condition at night or in dark areas, the light strobes 112 may only need to deliver low light output, e.g., 15 cd. Those same light strobes 112 may require higher light output, e.g., 75 cd, when the area lighting is on during the day. Even during the day some rooms may be unoccupied and the lights would be turned off which would thereby require lower light output, e.g., 15 cd. By using this light output control method, the light strobes 112 need only deliver sufficient light output levels as determined from the surrounding ambient light as measured, thereby significantly reducing power supply requirements and increasing battery reserves. For example, when a plurality of geographically separate light strobes are active, each light strobe 112 may be at a different light output level as determined by an associated light sensor 276 in combination with the light output determination method program running in the digital processor 252.

Figure 3:
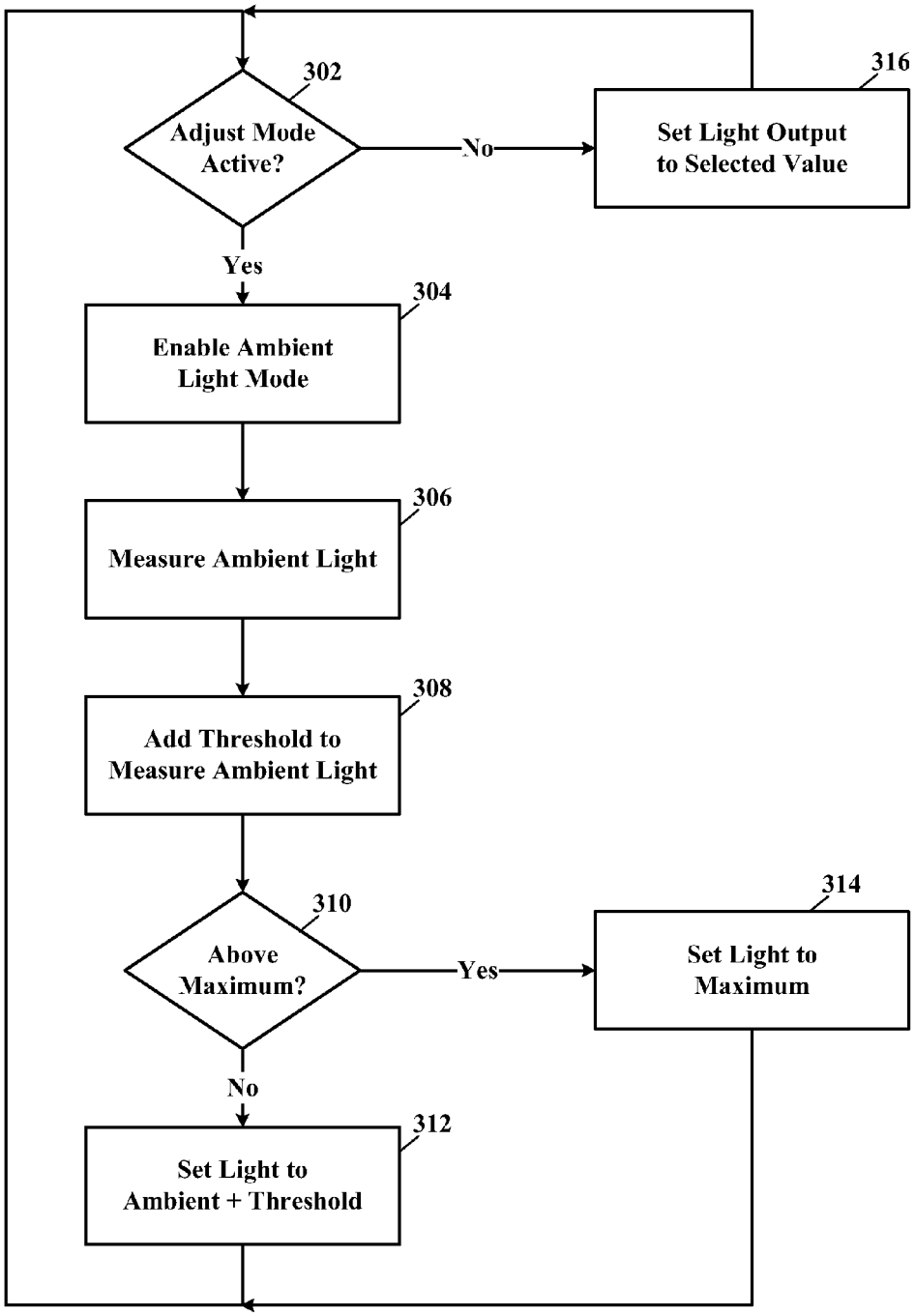
FIGS. 3 and 4 illustrate schematic process flow diagrams for determining background ambient light and audible noise then setting appropriate light and sound outputs sufficient to overcome presently existing background ambient light and audible noise conditions, according to specific example embodiments of this disclosure.

Referring to FIG. 3, depicted is a schematic process flow diagram for determining background ambient light and adjusting light strobe output in accordance with the determined background ambient light, according to a specific example embodiment of this disclosure. In step 302 a determination is made whether the adjust mode is active or not. If not, then in step 316 the light output is set to a selected fixed value. If the adjust mode is active then in step 304 an ambient light mode is enabled, and in step 306 the ambient light level is measured (determined). In step 308 a threshold value is added to the measured ambient light level. Then in step 310 the sum of the threshold value and the measured ambient light level is compared to a maximum light level value. If this sum is greater than the maximum light level value then in step 314 the light output is set at its maximum value (e.g., brightest light output). However, if the sum is not greater than the maximum light level value, then in step 312 the light output is set to the measured ambient light level plus the threshold value.

Furthermore, each smart notification appliance 108 may determine when an associated notification light strobe is in a power saving mode, full power mode, or light sensor fault mode, and transmit this status to the MNS host computer 102

Multi-Color Strobe

Another application for a smart notification appliance 108 is to accept commands for selecting different colors of light output. Typical notification appliances have a fixed color light output. If multiple colors are needed (for example WHITE for fire or AMBER for alert), multiple devices on multiple circuits would have to be employed. Light strobes 112 with the ability to change light color based upon system need may be commanded to generate a light output at different color types depending on the situation. The net effect is that within a circuit of multi-color strobe devices that are active, each strobe could be emitting light at a different color. Additionally, the auto adjusting feature described above can be combined to offer the energy saving features and self reporting mechanisms. It is anticipated and within the scope of this disclosure that red, green and blue light output sources, e.g., high power light emitting diodes (LEDs), may be intensity and/or time (pulse) modulated to produce any desired color output.

Auto Adjusting Speaker

Another application for a smart notification appliance 108 is to allow a voice-enabled notification appliance to be commanded to play selections from a plurality of prerecorded messages stored within a message memory 280. Traditional approaches to this have been a common analog audio circuit in which all audio output devices play the same audio recording or information. By using an addressable smart notification appliance 108, the master controller, e.g., MNS host computer 102, may instruct the voice-enabled smart notification appliance 108 to either play from a master audio signal or play from its stored audio message memory 280. This enables the system designer to coordinate far greater scenarios based upon the situation that is currently in play as opposed to always having the same voice instructions go to all audio annunciation circuits.

Additionally, tradition speaker devices are set at system installation for a given audio output power level that is for worst case conditions. The smart notification appliance 108 driving a speaker array 110 has the ability to auto adjust its audio output volume based upon the ambient noise (sound) conditions. In a noisy room with a high background sound level, more sound power is required. An audio (sound) sensor 274 may be coupled to the mixed signal processing apparatus 240 and may utilize an ambient sound detection method for determining an appropriate volume level of the speaker. In general, this ambient sound detection method may determine:

Sensor will sense ambient sound and adjust active sound output.

Transition sound conditions are considered by utilizing an integration method which may react on sound levels measured over a programmable period of time as opposed to instantaneous sound level transitions.

The method may be configured such that if there is a fault or failure within the sound sensor or other major parts of the audio reproduction circuits, the smart notification appliance 108 may communicate a trouble alert and have its sound output default to the maximum setting programmed into the smart notification appliance 108.

Similar to the aforementioned auto adjusting light strobe, there are power savings associated with the auto adjusting speaker method of the smart notification appliance 108.

Figure 4:
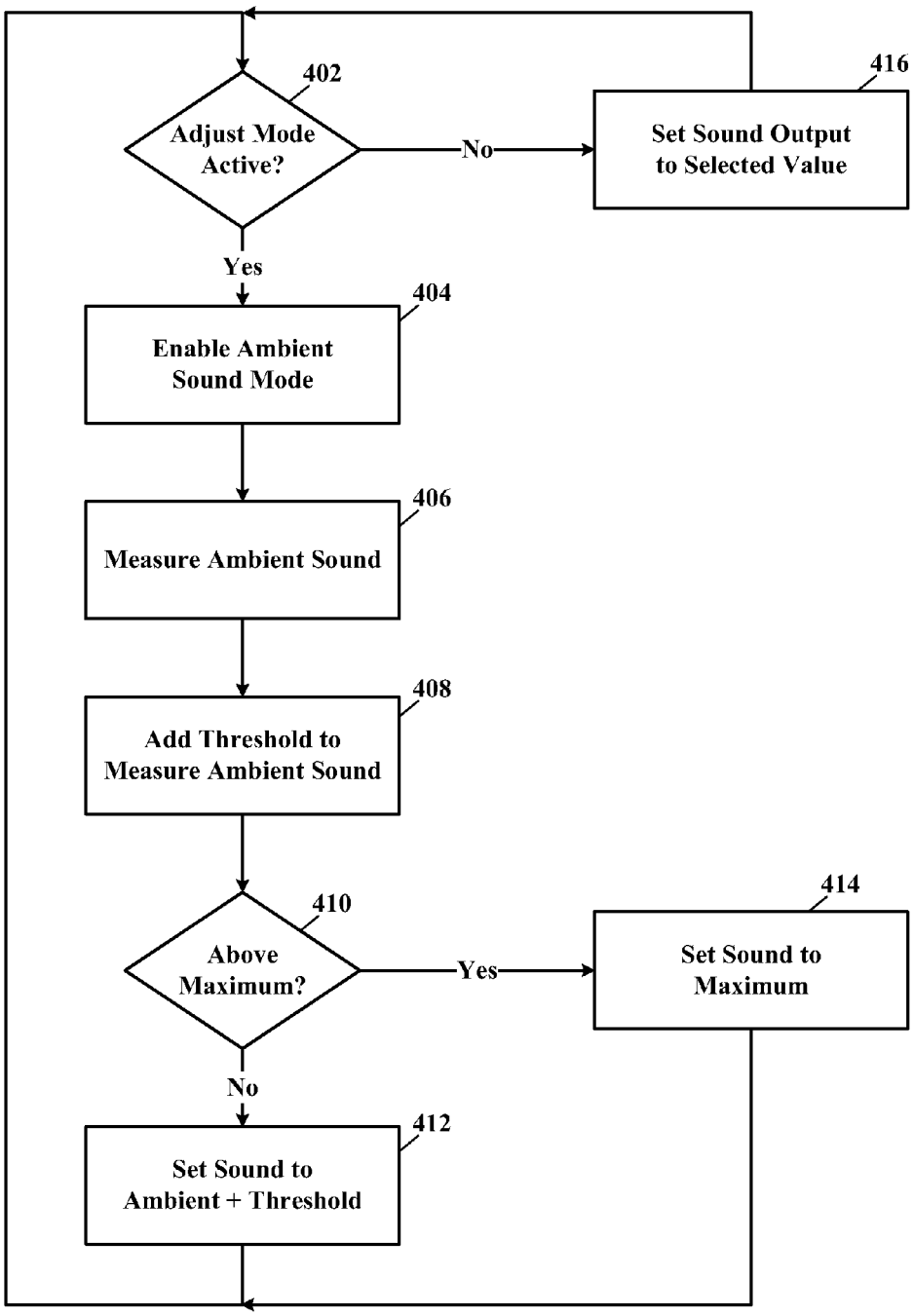

Referring to FIG. 4, depicted is a schematic process flow diagram for determining background ambient audible noise and adjusting speaker audio output in accordance with the determined background ambient audible noise, according to another specific example embodiment of this disclosure. In step 402 a determination is made whether the adjust mode is active or not. If not, then in step 416 the sound output is set to a selected fixed value. If the adjust mode is active then in step 404 an ambient sound mode is enabled, and in step 406 the ambient sound level is measured (determined). In step 408 a threshold value is added to the measured ambient sound level. Then in step 410 the sum of the threshold value and the measured ambient sound level is compared to a maximum sound level value. If this sum is greater than the maximum sound level value then in step 414 the sound output is set at its maximum value (e.g., maximum sound output). However, if the sum is not greater than the maximum sound level value, then in step 412 the sound output is set to the measured ambient sound level plus the threshold value.

Addressable Smart Appliances

The discussion above focused on applications for smart notification appliances. In order to enable error reporting from these smart notification appliances 108 and allow for the auto adjusting strobe, multi-color strobe, and smart speaker to be configured after system installation, a need exists to have unique addresses that may be correlated, controlled, and reacted to by a master controller or control panel, e.g., MNS host computer 102.

Regardless of the network topology chosen, a generic base addressable node can be implemented for each of the smart notification appliances 108 that allows for control over the MNS communications network and monitoring of communication interfaces that may be required by regulatory codes. The base addressable node combines the intelligence required to implement the "smart" capabilities described hereinabove as well as communicate with the overall MNS communications network.

While embodiments of this disclosure have been depicted, described, and are defined by reference to example embodiments of the disclosure, such references do not imply a limitation on the disclosure, and no such limitation is to be inferred. The subject matter disclosed is capable of considerable modification, alteration, and equivalents in form and function, as will occur to those ordinarily skilled in the pertinent art and having the benefit of this disclosure. The depicted and described embodiments of this disclosure are examples only, and are not exhaustive of the scope of the disclosure.

What is claimed is:

1. A smart notification appliance, comprising:

first and second communication ports;

first and second communications transceivers coupled to the first and second communication ports, respectively;

a message memory for storing at least one annunciation message;

a mixed signal processing apparatus coupled to the first and second communications transceivers, and the message memory, wherein the mixed signal processing apparatus comprises:

a digital processor and a program memory;

at least one digital-to-analog converter (DAC) coupled between the digital processor and at least one analog output;

an analog-to-digital converter (ADC) coupled to the digital processor;

an analog multiplexer coupled to the ADC and the digital processor, wherein at least one output of the digital processor is connected to an input of the analog multiplexer, wherein an output of the analog multiplexer is fed to an input of the ADC, and wherein the analog multiplexer has at least one other input that is coupled to the at least one analog input;

at least one digital receiver coupled between at least one digital input and the digital processor, wherein the digital receiver receives the at least one digital input, an output of a power good circuit, and an output of a power synchronization circuit as inputs; and at least one digital output driver coupled between the digital processor and an at least one digital output; and at least one power supply coupled to the first and second communication ports, the first and second communications transceivers, and the mixed signal processing apparatus, wherein the at least one analog input, the at least one analog output, the at least one digital input, and the at least one digital output are remotely monitored and controlled by a mass notification system through the first or the second communications port.

2. The smart notification appliance according to claim 1, further comprising a network time synchronization circuit for synchronizing time clocks in each one of a plurality of smart notification appliances coupled together through respective ones of the first and second communication ports.

3. The smart notification appliance according to claim 1, wherein the at least one power supply comprises at least two power supplies for redundancy and further comprises the power supply synchronization circuit coupled to the at least two power supplies and synchronizing together the at least two power supplies.

4. The smart notification appliance according to claim 1 further comprising a programming interface coupled to the digital processor.

5. The smart notification appliance according to claim 1, further comprising:

at least one sound sensor coupled to the at least one analog input; and at least one power speaker coupled to the at least one analog output;

wherein the least one sound sensor provides an ambient sound value to the mixed signal processing apparatus, and wherein the mixed signal processing apparatus controls a sound output level of the at least one power speaker at the ambient sound value plus a sound threshold value up to a maximum sound output level based on a comparison of the ambient sound value plus the sound threshold value with the maximum sound output level.

6. The smart notification appliance according to claim 1, further comprising smoke and fire detectors coupled through the analog or digital inputs to the mixed signal processing apparatus.

7. The smart notification appliance according to claim 1, further comprising intrusion detectors coupled through the analog or digital inputs to the mixed signal processing apparatus.

8. The smart notification appliance according to claim 1, further comprising:

at least one light sensor coupled to the at least one analog input; and at least one light strobe coupled to the at least one digital output;

wherein the least one light sensor provides an ambient light value to the mixed signal processing apparatus, and wherein the mixed signal processing apparatus controls a light output level of the at least one light strobe at the ambient light value plus a light threshold value up to a maximum light output level based on a comparison of the ambient light value plus the light threshold value with the maximum light output level.

9. The smart notification appliance according to claim 8, wherein the at least one light strobe comprises at least one power light emitting diode.

10. The smart notification appliance according to claim 8, wherein the at least one light strobe is a plurality of different colored light strobes controlled by the mixed signal processing apparatus.

* * * * *